US007044747B2

(12) United States Patent
Hung

(10) Patent No.: US 7,044,747 B2
(45) Date of Patent: May 16, 2006

(54) WIRING STRUCTURE AND FLAT PANEL DISPLAY

(75) Inventor: Meng-Yi Hung, Tao Yuan Shien (TW)

(73) Assignee: Quanta Display Inc., Tao Yuan Shien (TW)

( * ) Notice: Subject to any disclaimer, the term of this patent is extended or adjusted under 35 U.S.C. 154(b) by 13 days.

(21) Appl. No.: 10/911,914

(22) Filed: Aug. 5, 2004

(65) Prior Publication Data

US 2005/0250374 A1 Nov. 10, 2005

(30) Foreign Application Priority Data

May 6, 2004 (TW) ..... 93112732 A

(51) Int. Cl.
*H01R 12/00* (2006.01)

(52) U.S. Cl. ..... 439/67; 349/149

(58) Field of Classification Search ..... 439/55, 439/65, 67, 77; 349/149, 150, 152
See application file for complete search history.

(56) References Cited

U.S. PATENT DOCUMENTS 5,677,748 A * 10/1997 Tadokoro ..... 349/152
6,556,269 B1 * 4/2003 Takiar et al. ..... 349/150
6,836,310 B1 * 12/2004 Yamazaki et al. ..... 349/150
6,903,369 B1 * 6/2005 Chen et al. ..... 257/59

* cited by examiner

*Primary Examiner*—Khiem Nguyen
(74) *Attorney, Agent, or Firm*—Thomas, Kayden, Horstemeyer & Risley

(57) ABSTRACT

A wiring structure comprising a plurality of conductive wires coupled between a plurality of pixel terminals and a plurality of signal terminals of a flat panel display. Each conductive wire has a first portion of a first material with a first impedance and a second portion of a second material with a second impedance. Therefore, each conductive wire has the same impedance, thus enabling synchronous signal transmission and avoiding unstable display quality due to impedance disparity and asynchronous signals.

6 Claims, 3 Drawing Sheets

WIRING STRUCTURE AND FLAT PANEL DISPLAY

BACKGROUND

The present invention relates to a wiring structure and a flat panel display utilizing the same.

Typically, flat panel displays, such as liquid crystal displays (LCDs), require conductive wires as paths for signals transmitted from various integrated circuits (IC) to pixel terminals. As flat panel display size increasing, the pitch of pixel terminals is greater than the pitch of signal terminals in the ICs. The display quality is degraded because the different pitches result in conductive wires for signal transmission to have different lengths and impedances.

FIG. 1 is a schematic diagram of a conventional wiring structure. FIG. 1 shows the conventional conductive wire disposition method, wherein each conductive wire comprises a single material and contains a single straight line. The display quality is degraded because different pitches $P_1$ and $P_2$ respectively of pixel terminals of the conventional LCD and signal terminals of the ICs result in conductive wires between the pixel terminals $G_1$~$G_{N+1}$ and the signal terminals $T_1$~$T_{N+1}$ to have different lengths and impedances. FIG. 2 is a schematic diagram of another conventional wiring structure. As shown in FIG. 2, each conductive wire contains two straight line segments. Although the width of each conductive wire can be adjusted, each conductive wire still has a different impedance due to the space limited in the LCD. The display quality is degraded because of the different impedances.

SUMMARY

Accordingly, embodiments of the invention provide a wiring structure and in particular a wiring structure utilizing a plurality of conductive wires having the same impedance and comprising two portions of different materials.

Embodiments of the invention further provide a wiring structure comprising a plurality of conductive wires coupled between a plurality of pixel terminals and a plurality of signal terminals of a flat panel display. Each conductive wire has a first portion of a first material with a first impedance and a second portion of a second material with a second impedance. Accordingly, each conductive wire has the same impedance, so synchronous signal transmission is feasible, and unstable display quality due to impedance disparity and asynchronous signals is avoided.

A detailed description is given in the following embodiments with reference to the accompanying drawings.

BRIEF DESCRIPTION OF THE DRAWINGS

The present invention can be more fully understood by reading the subsequent detailed description and examples with references made to the accompanying drawings, wherein.

DETAILED DESCRIPTION

First Embodiment

Figure 1:
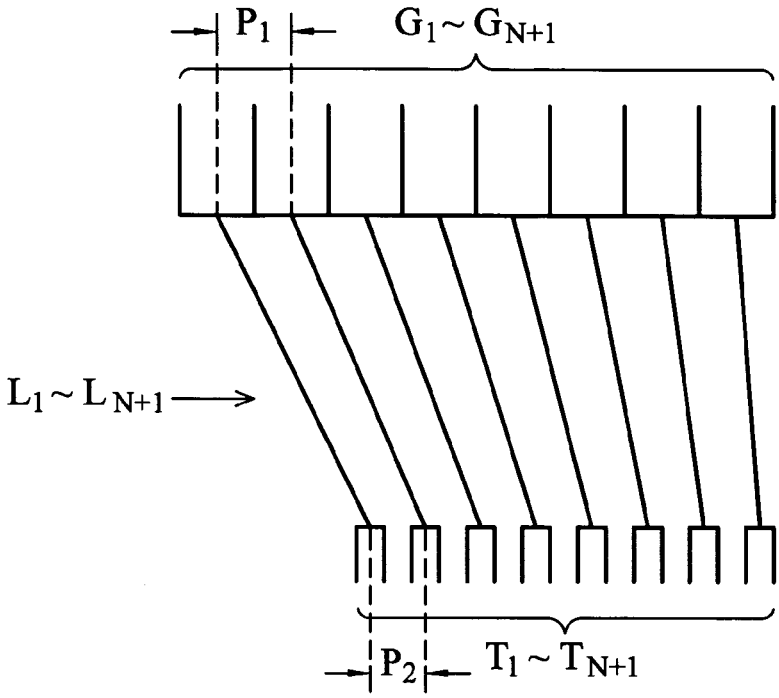
FIG. 1 (RELATED ART)
FIG. 1 is a schematic diagram of a conventional wiring structure.
Figure 2:
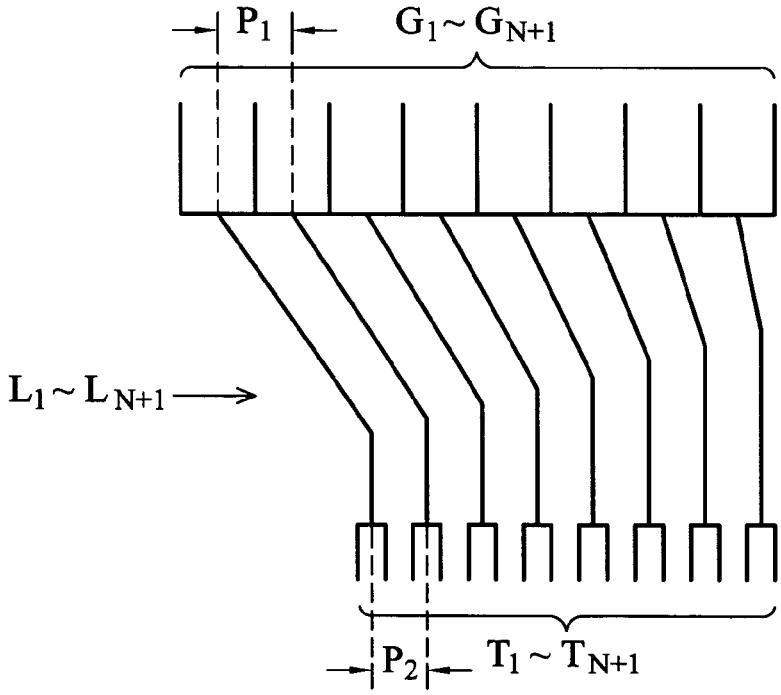
FIG. 2 (RELATED ART)
FIG. 2 is a schematic diagram of another conventional wiring structure.
Figure 3:
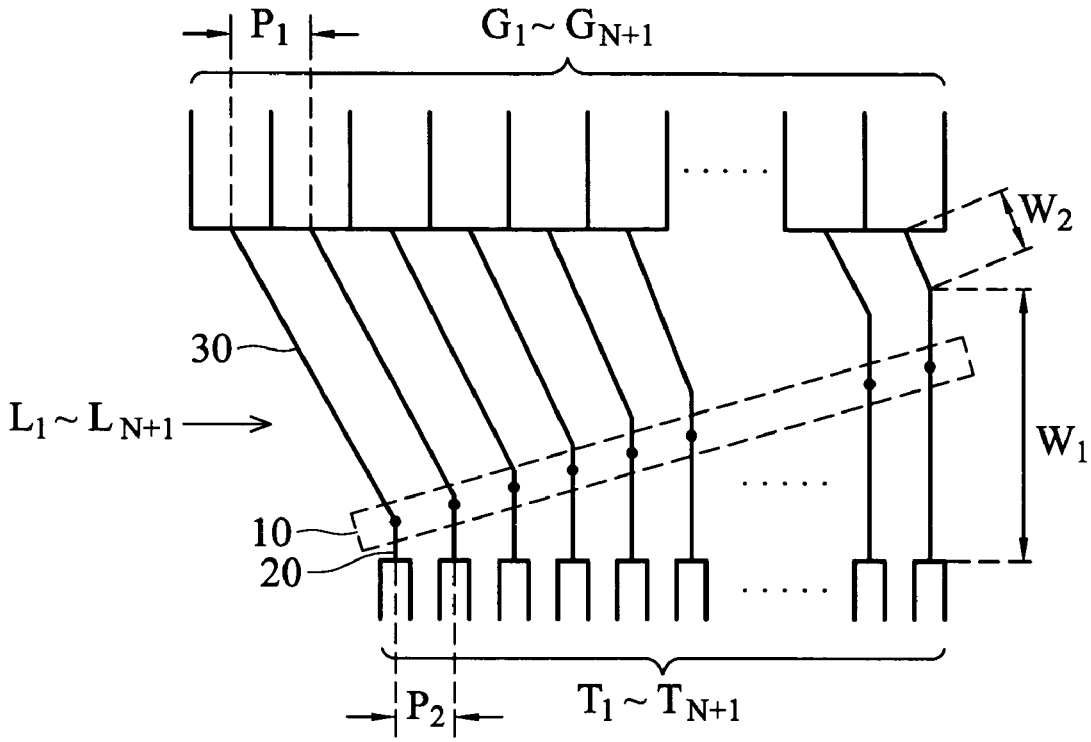
FIG. 3 is a schematic diagram of a wiring structure of an embodiment of the invention.

FIG. 3 is a schematic diagram of a wiring structure of this embodiment of the invention. As shown in FIG. 3, the wiring structure comprises a plurality of conductive wires $L_1$~$L_{N+1}$, coupled between a plurality of pixel terminals $G_1$~$G_{N+1}$ and a plurality of signal terminals $T_1$~$T_{N+1}$ of a flat panel display. Each conductive wire $L_1$~$L_{N+1}$ comprises a first portion 20 of a first material with a first impedance and a second portion 30 of a second material with a second impedance. The first impedance is different from the second impedance. Each conductive wire $L_1$~$L_{N+1}$ is divided into a first straight line segment $W_1$ and a second straight line segment $W_2$ by a turning point. Each first straight line segment $W_1$ of each conductive wire $L_1$~$L_{N+1}$ is disposed in parallel, and each second straight line segment $W_2$ of each conductive wire $L_1$~$L_{N+1}$ is also disposed in parallel. The first portion 20 and the second portion 30 of each conductive wire $L_1$~$L_{N+1}$ are connected via a connector 10 disposed on the first straight line segment $W_1$, thereby each conductive wire $L_1$~$L_{N+1}$ has the same impedance.

Figure 4:
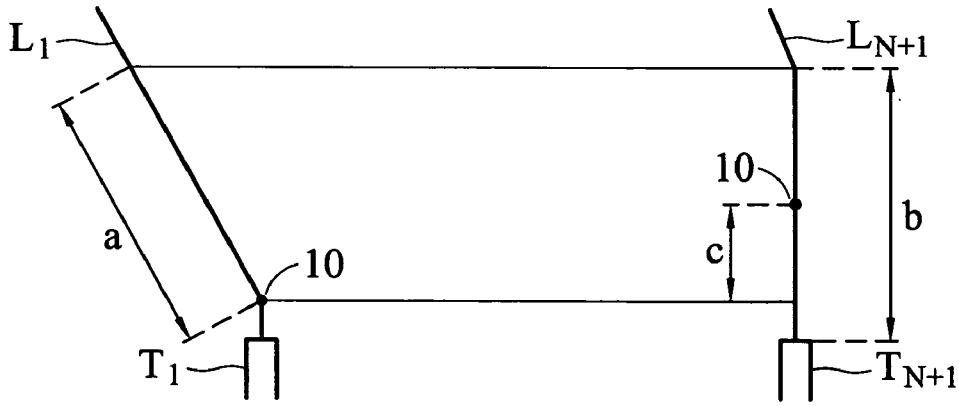
FIG. 4 is a diagram showing a disposition method of a connector of an embodiment of the invention.

FIG. 4 is a diagram showing a disposition method of a connector of this embodiment of the invention. As shown in FIG. 4, two conductive wires are partly drawn herein to derive a method for equalizing impedance of each conductive wire $L_1$~$L_{N+1}$. Parallel segments of equal length respectively of the first portion 20 and the second portion 30 of the conductive wire are omitted for simplicity. As shown in FIG. 4, the length of an oblique line segment a is greater than that of a straight line segment b, thus ensuring the connector 10 is disposed on a straight line extending in the direction of the signal terminals $T_1$~$T_{N+1}$. Moreover, the space required by the connector 10 is not affected by any variation of the conductive wires in the oblique direction.

The connector 10 connects the first portion 20 and the second portion 30 of each conductive wire $L_1$~$L_{N+1}$. The impedance of each conductive wire $L_1$~$L_{N+1}$ can be equalized by adjusting the position of the connector 10 on each conductive wire $L_1$~$L_{N+1}$ using the following formula:

$$a/WA\times\chi=(b-c)/WA\times\chi+c/WB\times m\chi.$$

Therefore, the length c can be calculated by $$c=(a-b)\times WB/m\times WA-WB', \text{ wherein}$$

c represents the length of the first portion 20 in parallel with the straight line segment b;

WA represents the width of the second portion 30;

WB represents the width of the first portion 20;

$\chi$ represents the resistance coefficient of the second portion 30; and $m\chi$ represents the resistance coefficient of the first portion 20.

Using a first conductive wire $L_1$ as a reference base, the position of the connector 10 on another conductive wire $L_{N+1}$ can be calculated by the above formula. Additionally, the impedance of each conductive wire $L_1$~$L_{N+1}$ can be equalized by adjusting other parameters in the above formula, for example, the widths WA and WB of the first portion 20 and the second portion 30.

Second Embodiment

Figure 5:
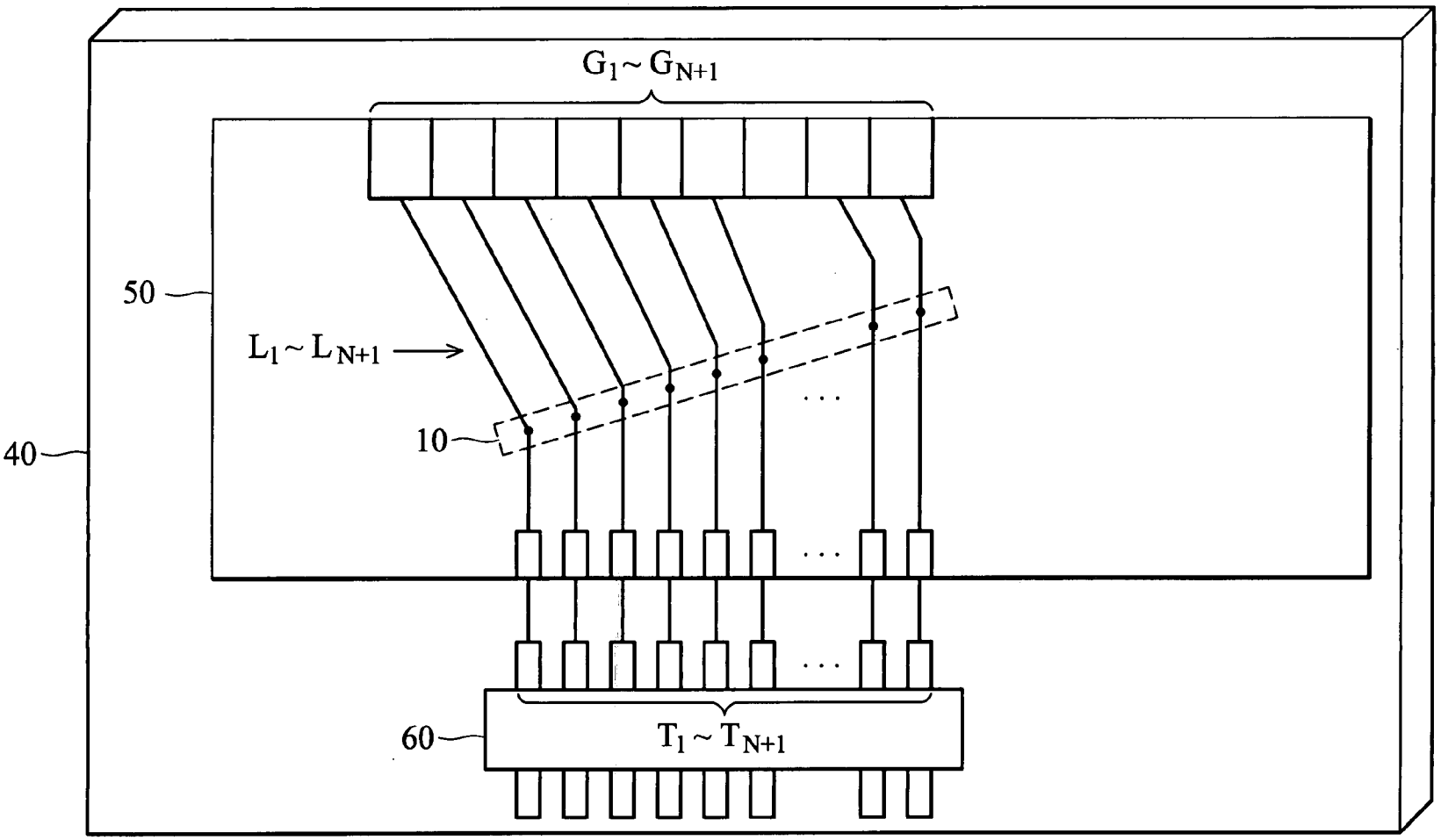
FIG. 5 is a block diagram of a flat panel display of an embodiment of the invention.

FIG. 5 is a block diagram of a flat panel display of this embodiment of the invention. As shown in FIG. 5, the flat panel display 40 comprises a panel 50, a plurality of integrated circuits (IC) 60, and a wiring structure. The panel 50 displays images and comprises at least a plurality of pixel terminals $G_1$~$G_{N+1}$. The ICs 60 drive the panel 50 and comprise at least a plurality of signal terminals $T_1$~$T_{N+1}$. Pitches $P_1$ of the pixel terminals are greater than pitches $P_2$ of the signal terminals. The wiring structure comprises a plurality of conductive wires $L_1$~$L_{N+1}$ coupled between the pixel terminals $G_1$~$G_{N+1}$ and the signal terminals $T_1$~$T_{N+1}$. Each conductive wire $L_1$~$L_{N+1}$ comprises a first portion 20 of a first material with a first impedance and a second portion 30 of a second material with a second impedance. Each conductive wire $L_1$~$L_{N+1}$ has the same impedance. The principle behind the wiring structures of the first and the second embodiments are the same. Accordingly, each conductive wire $L_1$~$L_{N+1}$ has the same impedance, so synchronous signal transmission is feasible, and unstable display quality due to impedance disparity and asynchronous signals is avoided.

While the invention has been described by way of example and in terms of the preferred embodiments, it is to be understood that the invention is not limited to the disclosed embodiments. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A flat panel display, comprising:

a panel, for displaying images, comprising at least a plurality of pixel terminals;

a plurality of integrated circuits (IC), for driving the panel, comprising at least a plurality of signal terminals, wherein pitches of the pixel terminals are greater than pitches of the signal terminals;

a wiring structure comprising a plurality of conductive wires, coupled between the pixel terminals and the signal terminals, each conductive wire comprising a first portion of a first material with a first impedance and a second portion of a second material with a second impedance, and each conductive wire having the same impedance.

2. The flat panel display as claimed in claim 1, wherein each conductive wire is divided into a first straight line segment and a second straight line segment by a turning point.

3. The flat panel display as claimed in claim 2, wherein the first straight line segment of each conductive wire is disposed in parallel, and the second straight line segment of each conductive wire is also disposed in parallel.

4. The flat panel display as claimed in claim 3, wherein the first portion and the second portion of each conductive wire are connected via a connector.

5. The flat panel display as claimed in claim 4, wherein the connector is disposed on the fast straight line segment.

6. The flat panel display as claimed in claim 4, wherein the connector is disposed on the second straight line segment.

* * * * *